US006192212B1

(12) United States Patent
Kunihiro et al.

(10) Patent No.: US 6,192,212 B1
(45) Date of Patent: Feb. 20, 2001

(54) IMAGE FORMING APPARATUS

(75) Inventors: Hisashi Kunihiro, Nara; Takahiro Kimura, Ikoma; Akira Nakakuma, Nara, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/492,384

(22) Filed: Jan. 27, 2000

(30) Foreign Application Priority Data

Feb. 10, 1999 (JP) ..... 11-032341

(51) Int. Cl.[7] ..... G03G 21/10
(52) U.S. Cl. ..... 399/253; 399/359
(58) Field of Search ..... 399/253, 255, 399/256, 358, 359

(56) References Cited

U.S. PATENT DOCUMENTS 5,493,382 * 2/1996 Takagaki et al. ..... 399/298
5,526,100 * 6/1996 Misago et al. ..... 399/246
5,604,575 * 2/1997 Takagaki et al. ..... 399/359
5,734,957 * 3/1998 Ogawa et al. ..... 399/359
5,802,430 * 9/1998 Wada ..... 399/253
6,108,511 * 8/2000 Kutsuwada et al. ..... 399/359

FOREIGN PATENT DOCUMENTS 5249824 9/1993 (JP) .

* cited by examiner

*Primary Examiner*—Richard Moses

(57) ABSTRACT

In image forming, the ratio of foreign substances mixed in the recycled toner which is removed from the photoreceptor drum surface by means of the cleaning device is computed as one of the characteristics of the recycled toner, based on the paper size, the image area and the transfer efficiency. If the recycled toner has a high ratio of foreign substances mixed therein and is determined to have a low quality, collection of the recycled toner into the developing unit is temporarily interrupted and a fixed amount of toner is conveyed from the developing unit to the cleaning device so as to improve the quality of the recycled toner. In this way, recycled toner of a low quality is prohibited from being used for subsequent image forming operations so as to prevent degradation of the image quality.

8 Claims, 6 Drawing Sheets

FIG.5

| MAGNI-FICATION | ORIGI-NAL SIZE | PAPER SIZE | PRINT AREA ($mm^2$) | | | TONER CONSUMPTION | | | TRANSFER EFFI-CIENCY | RECYCLED TONER AMOUNT | | | EMERGENT AMOUNT OF FOREIGN SUBSTANCES | | |
|---|---|---|---|---|---|---|---|---|---|---|---|---|---|---|---|
| | | | LOW-DENSITY PRINT | NORMAL | HIGH-DENSITY PRINT | LOW-DENSITY PRINT | NORMAL | HIGH-DENSITY PRINT | | LOW-DENSITY PRINT | NORMAL | HIGH-DENSITY PRINT | LOW-DENSITY PRINT | NORMAL | HIGH-DENSITY PRINT |
| 200 | A5 | A3 | 2494.8 | 7484.4 | 24948 | 0.666W | 2W | 6.666W | | 0.666W(1-η) | 2W(1-η) | 6.666W(1-η) | 0.666X | 2X | 6.666X |
| 141 | A5 | A4 | 1247.4 | 3742.2 | 12474 | 0.333W | W | 3.333W | | 0.333W(1-η) | W(1-η) | 3.333W(1-η) | 0.333X | X | 3.333X |
| | A4 | A3 | 2494.8 | 7484.4 | 24948 | 0.666W | 2W | 6.666W | | 0.666W(1-η) | 2W(1-η) | 6.666W(1-η) | 0.666X | 2X | 6.666X |
| | B5 | B4 | 1870.96 | 5612.88 | 18709.6 | 0.500W | 1.5W | 5.000W | | 0.500W(1-η) | 1.5W(1-η) | 5.000W(1-η) | 0.500X | 1.5X | 5.000X |
| 122 | A5 | B5 | 935.48 | 2806.44 | 9354.8 | 0.250W | 0.75W | 2.500W | | 0.250W(1-η) | 0.75W(1-η) | 2.500W(1-η) | 0.250X | 0.75X | 2.500X |
| | A4 | B4 | 1870.96 | 5612.88 | 18709.6 | 0.500W | 1.5W | 5.000W | | 0.500W(1-η) | 1.5W(1-η) | 5.000W(1-η) | 0.500X | 1.5X | 5.000X |
| 115 | B5 | A4 | 1247.4 | 3742.2 | 12474 | 0.333W | W | 3.333W | | 0.333W(1-η) | W(1-η) | 3.333W(1-η) | 0.333X | X | 3.333X |
| | B4 | A3 | 2494.8 | 7484.4 | 24948 | 0.666W | 2W | 6.666W | | 0.666W(1-η) | 2W(1-η) | 6.666W(1-η) | 0.666X | 2X | 6.666X |
| 100 | A5 | A5 | 621.6 | 1864.8 | 6216 | 0.166W | 0.5W | 1.666W | | 0.166W(1-η) | 0.5W(1-η) | 1.666W(1-η) | 0.166X | 0.5X | 1.666X |
| | A4 | A4 | 1247.4 | 3742.2 | 12474 | 0.333W | W | 3.333W | | 0.333W(1-η) | W(1-η) | 3.333W(1-η) | 0.333X | X | 3.333X |
| | A3 | A3 | 2494.8 | 7484.4 | 24948 | 0.666W | 2W | 6.666W | η | 0.666W(1-η) | 2W(1-η) | 6.666W(1-η) | 0.666X | 2X | 6.666X |
| | B5 | B5 | 935.48 | 2806.44 | 9354.8 | 0.250W | 0.75W | 2.500W | | 0.250W(1-η) | 0.75W(1-η) | 2.500W(1-η) | 0.250X | 0.75X | 2.500X |
| | B4 | B4 | 1870.96 | 5612.88 | 18709.6 | 0.500W | 1.5W | 5.000W | | 0.500W(1-η) | 1.5W(1-η) | 5.000W(1-η) | 0.500X | 1.5X | 5.000X |
| 86 | A4 | B5 | 935.48 | 2806.44 | 9354.8 | 0.250W | 0.75W | 2.500W | | 0.250W(1-η) | 0.75W(1-η) | 2.500W(1-η) | 0.250X | 0.75X | 2.500X |
| | A3 | B4 | 1870.96 | 5612.88 | 18709.6 | 0.500W | 1.5W | 5.000W | | 0.500W(1-η) | 1.5W(1-η) | 5.000W(1-η) | 0.500X | 1.5X | 5.000X |
| 81 | B5 | A5 | 621.6 | 1864.8 | 6216 | 0.166W | 0.5W | 1.666W | | 0.166W(1-η) | 0.5W(1-η) | 1.666W(1-η) | 0.166X | 0.5X | 1.666X |
| | B4 | A4 | 1247.4 | 3742.2 | 12474 | 0.333W | W | 3.333W | | 0.333W(1-η) | W(1-η) | 3.333W(1-η) | 0.333X | X | 3.333X |
| 70 | A4 | A5 | 621.6 | 1864.8 | 6216 | 0.166W | 0.5W | 1.666W | | 0.166W(1-η) | 0.5W(1-η) | 1.666W(1-η) | 0.166X | 0.5X | 1.666X |
| | A3 | A4 | 1247.4 | 3742.2 | 12474 | 0.333W | W | 3.333W | | 0.333W(1-η) | W(1-η) | 3.333W(1-η) | 0.333X | X | 3.333X |
| | B4 | B5 | 935.48 | 2806.44 | 9354.8 | 0.250W | 0.75W | 2.500W | | 0.250W(1-η) | 0.75W(1-η) | 2.500W(1-η) | 0.250X | 0.75X | 2.500X |
| 50 | A3 | A5 | 621.6 | 1864.8 | 6216 | 0.166W | 0.5W | 1.666W | | 0.166W(1-η) | 0.5W(1-η) | 1.666W(1-η) | 0.166X | 0.5X | 1.666X |

IMAGE FORMING APPARATUS

BACKGROUND OF THE INVENTION (1) Field of the Invention

The present invention relates to an image forming apparatus such as a copier, printer etc., for performing electrophotographic image formation, in particular, relating to an image forming apparatus having a toner recycling function of reusing the toner collected from the photoreceptor surface.

(2) Description of the Prior Art

In the image forming process using the electrophotographic technique effected in image forming apparatus such as copiers, printers and the like, a static latent image is formed on the photoreceptor surface by the photoconductive effect and developed into a visual image with a powder developer supplied from a developing device. This visual image supported on the photoreceptor is transferred to a recording medium. At that event, some part of the developer constituting the visual image on the photoreceptor surface will remain on the photoreceptor surface, failing to transfer to the recording medium. In general the photoreceptor surface is used repeatedly for image forming operations, so if the remaining developer is left as it is on the photoreceptor surface, this will cause degradation of the image quality for subsequent image forming operations. Therefore, the developer left on the photoreceptor surface after the transfer step is removed by means of a cleaning device and discarded.

If all the developer not having been used for image forming on the recording medium during the image forming operation is to be discarded, the developer is wasted, raising the running cost.

A conventional image forming apparatus using a dual-component developer consisting of a toner and a carrier has a so-called toner recycling function for collecting the toner which has been removed from the photoreceptor surface by a cleaning device, into the developing device, and reusing the toner thus removed from the photoreceptor surface for subsequent image forming, to thereby avoid waste of toner and realize a reduction in running cost.

Typically, as shown in FIG. 1, provided around and opposing a photoreceptor drum 51 are a primary charger 52, a developing unit 54, a transfer device 55, a cleaning device 57 and a charge erasing device 58, in this sequential order, and furthermore, a conveying device 59 for conveying toner from the cleaning device 57 to the developing unit 54. Cleaning device 57 located between transfer device 55 and primary charger 52 with respect to the rotational direction of photoreceptor drum 51 includes a scraper member 57*a* such as a blade etc., abutting the surface of photoreceptor drum 51 and collects the toner remaining on photoreceptor drum 51 after passage of the opposing position of transfer device 55 and falling into cleaning device 57. The toner collected in cleaning device 57 is conveyed to developing unit 54 by driving at an appropriate timing, a conveying device 59 constituted by, for example, a screw conveyer mechanism.

In order to maintain a constant density of the image formed on the recording medium in the image forming operation by the electrophotographic technique using a dual-component developer, a necessary and sufficient amount of toner for developing the static latent image needs to be stored in the developing unit. Therefore, a conventional image forming apparatus, for example, includes a toner concentration sensor such as a magnetic permeameter or the like which detects the amount of the toner stored in the developing unit based on the detection signal from the toner concentration sensor and replenishes the developing unit with the toner based on the detection result. Since only the toner among the developer is consumed during the image forming process while the stored amount of the carrier in the developing unit will be theoretically unchanged, variation in the ratio of the toner to the developer consisting of the magnetic component, i.e., the carrier and the non-magnetic toner will appear as the change in magnetic permeability of the developer. Accordingly, the amount of the toner stored in the developing unit can be obtained from the detection result of the permeability of the developer by the magnetic permeability sensor.

However, so-called recycled toner, which has been removed from the photoreceptor surface after the transfer step and collected into the developing unit contains foreign substances such as paper dust, talc etc. from the paper as the recording medium and this recycled toner is returned into the developing unit, so that the foreign substances mixed with the developer have an influence on the detection result of the toner concentration sensor. However, there has been no conventional image forming apparatus having a toner recycling function, which takes into consideration the variation of the detection result of the toner concentration sensor due to the foreign substances mixed with the developer in the developing unit. Thus, it has been impossible to detect an exact amount of the toner stored in the developing unit, which might cause surplus or deficiency of the amount of the toner replenishing the developing unit, making it impossible to maintain correct image density.

Further, the amount of foreign substances contained in the recycled toner will vary depending upon image forming conditions such as the number of image forming operations, the sizes of recording media as well as environmental conditions such as temperature, humidity etc. Therefore, it has been impossible to definitely determine the amount of foreign substances mixed in the developer based on the amount of the recycled toner collected into the developing unit, and it has not been easy to compensate the errors arising in the detection result of the toner concentration due to mixture of foreign substances in the developing unit. Hence, it has been difficult for an image forming apparatus having a toner recycling function to keep a correct image density.

SUMMARY OF THE INVENTION

It is therefore an object of the present invention to provide an image forming apparatus which can constantly store an appropriate amount of toner in the developing unit and maintain proper image forming conditions such as image density etc., regardless of the amount of foreign substances mixed in with the developer, by predicting the amount of foreign substances mixed in the developing unit based on the image forming conditions and the environmental conditions and controlling the stored amount of the toner in the developing unit based on the prediction.

The present invention has been devised in order to the above object and is configured as follows:

In accordance with the first aspect of the present invention, an image forming apparatus for forming images by electrophotography using a dual-component developer consisting of a toner and a carrier wherein the toner remaining on the photoreceptor surface after completion of the transfer step is removed by the cleaning device, collected and returned to the developing portion as the recycled toner and reused together with the fresh toner for a subsequent developing step, includes a controller which predicts the characteristics of the recycled toner based on the image forming conditions and the environmental conditions for individual image forming operations and executes control of the storage state of the toner in the developing portion in accordance with the prediction.

In accordance with the second aspect of the present invention, the image forming apparatus having the above first feature is characterized in that the characteristics of the recycled toner predicted by the controller include the state of foreign substances mixed in the recycled toner.

In accordance with the third aspect of the present invention, the image forming apparatus having the above second feature is characterized in that the controller comprises:

a means for measuring the numbers of image forming operations for individual sizes of recording media used for image forming operations as the image forming conditions having influence on the emergent amount of paper dust; and a means for measuring the temperature and humidity during image forming as the environmental conditions having influence on the amount of recycled toner.

In accordance with the fourth aspect of the present invention, the image forming apparatus having the above first, second or third features is characterized in that the control made by the controller includes the step of controlling the amount of the fresh toner replenishing the developing portion.

In accordance with the fifth aspect of the present invention, the image forming apparatus having the above first, second or third features is characterized in that the control made by the controller comprises a step of constraining collection of the recycled toner to the developing portion.

In accordance with the sixth aspect of the present invention, the image forming apparatus having the above first, second or third features is characterized in that the control made by the controller comprises a control step for improving the characteristics of the recycled toner.

In accordance with the seventh aspect of the present invention, the image forming apparatus having the above sixth feature is characterized in that the control for improving the characteristics of the recycled toner is a toner consuming operation for conveying the toner stored in the developing portion to the cleaning device by way of the photoreceptor surface.

In accordance with the eighth aspect of the present invention, the image forming apparatus having the above seventh feature is characterized in that the toner consuming operation is effected during a non-image forming operation.

In the invention described in the first feature, the storage state of the toner in the developing portion is controlled in accordance with the characteristics of the recycled toner that have been predicted based on the image forming conditions and environmental conditions for individual image forming operations. Therefore, when the recycled toner having varying characteristics depending upon the image forming conditions and environmental conditions for individual image forming operations is collected into the developing portion and reused together with the fresh toner for subsequent image forming operations, the storage state of the recycled toner and fresh toner in the developing portion is controlled based on the characteristics of the recycled toner, to thereby regulate the influence of the characteristics of the recycled toner upon the image forming state.

In the invention described in the second feature, the storage state of the toner in the developing portion is controlled based on the state of foreign substances mixed in the recycled toner. Therefore, the storage state of the recycled toner and fresh toner in the developing portion is controlled based on the state of foreign substances mixed in the recycled toner, to thereby regulate the influence of the state of foreign substances mixed in the recycled toner upon the image forming state.

In the invention described in the third feature, the state of foreign substances mixed in the recycled toner is predicted based on the measurements of the numbers of image forming operations for individual sizes of recording media as the image forming factors having influence on the emergent amount of paper dust and based on the measurements of the temperature and humidity during image forming as the factors having influence on the transfer efficiency which determines the amount of recycled toner. The storage state of the recycled toner and fresh toner in the developing portion is controlled based on the predicted result. Therefore, the storage state of the recycled toner and fresh toner in the developing portion is controlled based on the predicted amount of paper dust mixed in the recycled toner, which is predicted from the emergent amount of paper dust based on the numbers of image forming operations for individual sizes of recording media and from the amount of recycled toner based on the temperature and humidity during image forming. As a result, the influence of the amount of paper dust mixed in the recycled toner upon the image forming state is regulated.

In the invention described in the fourth feature, the amount of the fresh toner replenishing the developing portion is controlled in accordance with the characteristics of the recycled toner that have been predicted based on the image forming conditions and environmental conditions for individual image forming operations. Therefore, when the recycled toner having varying characteristics depending upon the image forming conditions and environmental conditions for individual image forming operations is collected into the developing portion and reused together with the fresh toner for subsequent image forming operations, the ratio of the fresh toner occupying in the developer in the developing portion is controlled based on the characteristics of the recycled toner, to thereby regulate the influence of the characteristics of the recycled toner upon the image forming state.

In the invention described in the fifth feature, the amount of collection of the recycled toner into the developing portion is controlled in accordance with the characteristics of the recycled toner that have been predicted based on the image forming conditions and environmental conditions for individual image forming operations. Therefore, when the recycled toner having varying characteristics depending upon the image forming conditions and environmental conditions for individual image forming operations is collected into the developing portion and reused together with the fresh toner for subsequent image forming operations, the ratio of the recycled toner occupying in the developer in the developing portion can be controlled based on the characteristics of the recycled toner, to thereby regulate the influence of the characteristics of the recycled toner upon the image forming state.

In the invention described in the sixth feature, the characteristics of the recycled toner are improved in accordance with the characteristics of the recycled toner that have been predicted based on the image forming conditions and environmental conditions for individual image forming operations. Therefore, the recycled toner improved in its characteristics is used together with the fresh toner for subsequent image forming operations, to thereby regulate the influence of the characteristics of the recycled toner upon the image forming state.

In the invention described in the seventh feature, the toner consuming operation for conveying the toner stored in the developing portion to the cleaning device via the photoreceptor surface is effected in accordance with the characteristics of the recycled toner that have been predicted based on the image forming conditions and environmental conditions for individual image forming operations. Therefore, the fresh toner stored in the developing portion is mixed with the recycled toner in the cleaning device by way of the photoreceptor surface so as to lower the mixed ratio of foreign substances in the recycled toner whereby the influence of the characteristics of the recycled toner upon the image forming state is regulated.

In the invention described in the eighth feature, the toner consuming operation for conveying the toner stored in the developing portion to the cleaning device via the photoreceptor surface is effected during a non-image forming operation in accordance with the characteristics of the recycled toner that have been predicted based on the image forming conditions and environmental conditions for individual image forming operations. Therefore, the characteristics of the recycled toner is improved without having any influence on image forming and the recycled toner improved in its characteristics is used for subsequent image forming operations.

BRIEF DESCRIPTION OF THE DRAWINGS

FIG. 5 is a chart showing table contents stored in a ROM provided for the CPU making up the controller; and, FIG. 6 is a flowchart showing partial procedural steps effected by the controller of an image forming apparatus in accordance with another embodiment of the present invention.

DESCRIPTION OF THE PREFERRED EMBODIMENTS

Figure 1:
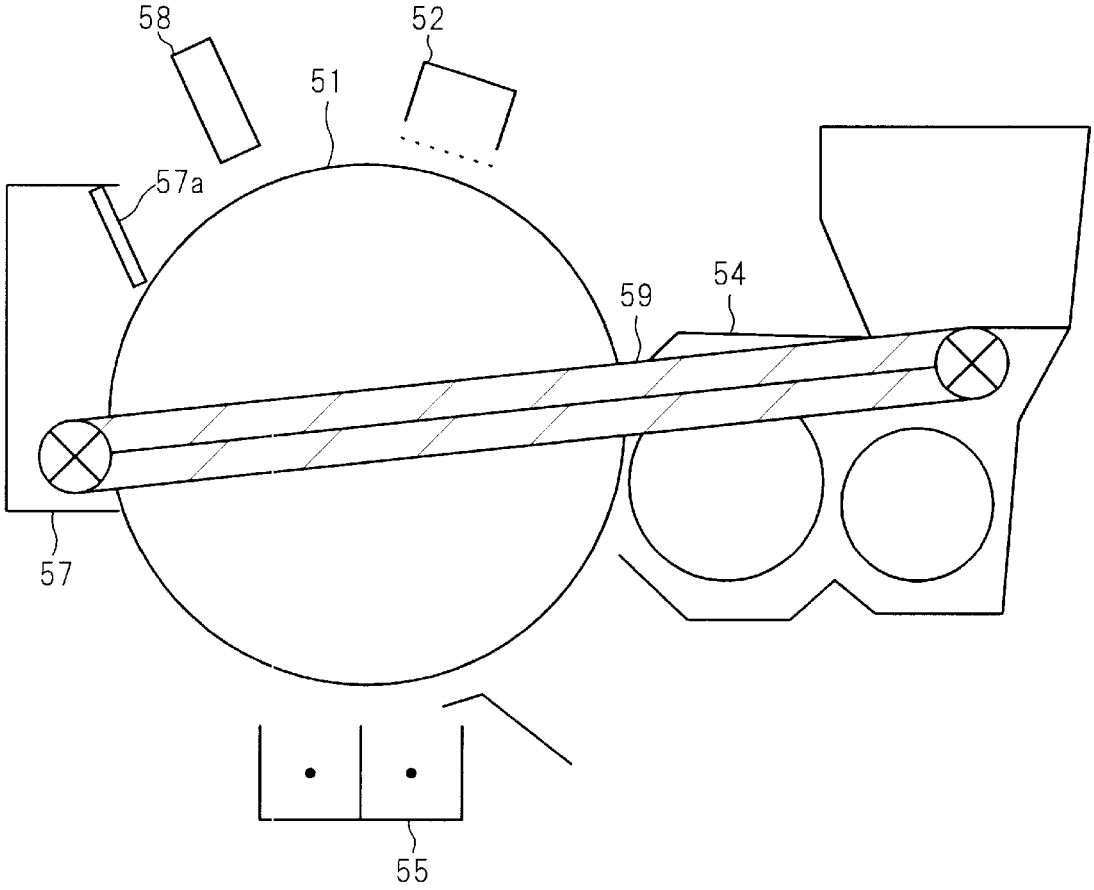
FIG. 1 PRIOR ART
FIG. 1 is a schematic view showing a configuration of an image forming portion in a conventional image forming apparatus.
Figure 2:
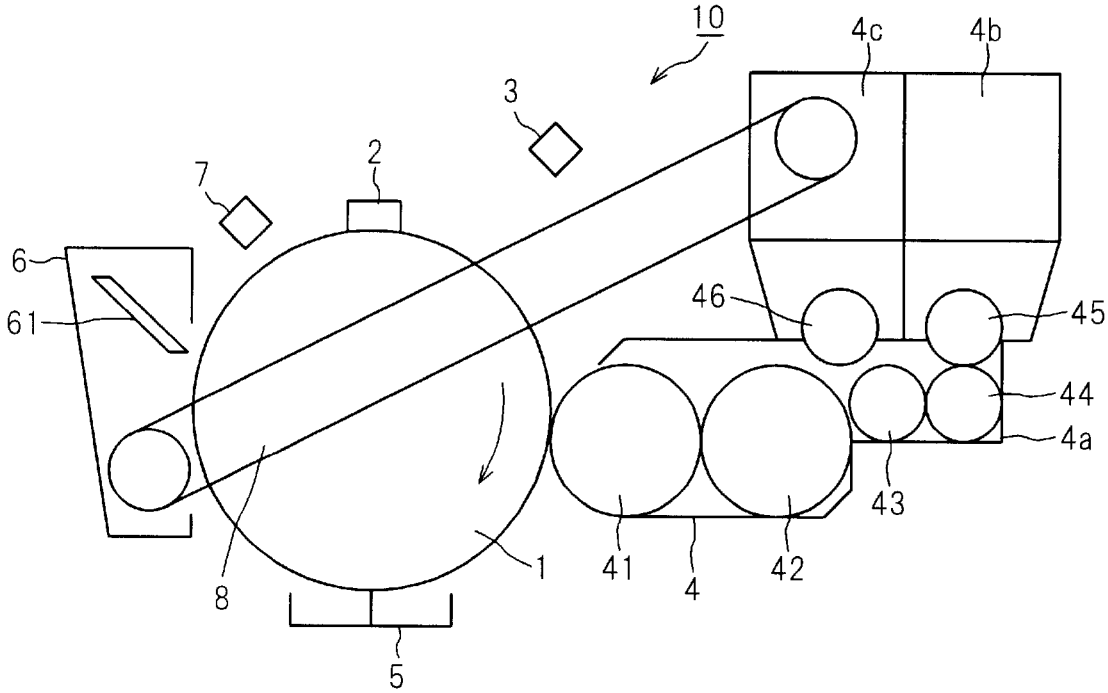
FIG. 2 is a schematic front sectional view showing the configuration of an image forming portion of an image forming apparatus in accordance with the embodiment of the present invention.

FIG. 2 is a schematic front sectional view showing the configuration of an image forming portion of an image forming apparatus in accordance with the embodiment of the present invention. The image forming portion, designated at 10, of this image forming apparatus has a photoreceptor drum 1 rotating at a constant rate and includes therearound a charger 2, a writing unit 3, a developing unit 4, a transfer device 5, a cleaning device 6 and an erasing device 7. This further has a recycling device 8.

Developing unit 4 includes: a developing hopper 4*a* which axially supports a developing roller 41, agitating rollers 42 to 44 and replenishing rollers 45 and 46; a replenishing vessel 4*b* storing unused or fresh toner and a collecting vessel 4*c* for storing the recycled toner, both arranged on the top of the developing hopper. The fresh toner stored in replenishing vessel 4*b* and the recycled toner stored in collecting vessel 4*c* replenish developing hopper 4*a* by rotation of replenishing rollers 45 and 46, respectively.

The fresh toner and recycled toner supplied to developing hopper 4*a* are blended with the developer of carrier and toner already stored in developing hopper 4*a*, by means of agitating rollers 42 to 44 so that the toner particles carry predetermined amount of charge and electrostatically adhere to the carrier surfaces. The developer made up of carriers having the toner attracted to the surfaces thereof forms a brush-like texture or spikes standing upright on the peripheral surface of developing roller 41 by virtue of the magnetism from magnetic poles incorporated in developing roller 41 and is conveyed, as developing roller 41 rotates, to the developing position where the peripheral surface of developing roller 41 most closely approaches the surface of photoreceptor drum 1. In this developing position, the toner alone transfers to the static latent image formed on the surface of photoreceptor drum 1.

Cleaning device 6 has a scraper member 61 therein. This scraper member 61 is typically a blade, for example, which abuts the surface of photoreceptor drum 1 at its one end at a predetermined pressure and scrapes the toner not having transferred to the paper and remaining on the surface of photoreceptor drum 1 and paper dust etc. adhering thereto from the paper. The residue thus scraped from the photoreceptor drum 1 surface is temporarily stored in the interior of cleaning device 6. The lower portion of cleaning device 6 and the upper portion of collecting vessel 4*c* of developing unit 4 are connected by recycling device 8. This recycling device 8 is made up of a screw conveyer, for example.

Photoreceptor drum 1 has a photoconductive layer on its peripheral surface and rotates in the direction of the arrow at a constant speed during image forming. Charger 2 uniformly supplies charge of a single polarity onto the peripheral surface of photoreceptor drum 1. Writing unit 3, based on the image data supplied from an aftermentioned controller, illuminates the surface of photoreceptor drum 1 with light of an image by a laser beam, for example. Formed on the surface of photoreceptor drum 1 thus illuminated with light of an image is a static latent image produced by the photoconductive effect. Developing unit 4 supplies the toner to the static latent image thus formed on the surface of photoreceptor drum 1 so as to develop the static latent image into a toner image. Transfer device 5 transfers the toner image carried on the photoreceptor drum 1 surface to the surface of the paper which has been conveyed at a predetermined timing from an unillustrated paper feed portion. Cleaning device 6 removes the toner etc., remaining on the surface of photoreceptor drum 1 after the end of the transfer step. Erasing device 7 erases the charge residing on the photoreceptor drum 1 surface after the end of the transfer step.

The paper having passed through the transfer station is conveyed to an unillustrated fixing unit where it is heated and pressed. Heating and pressing in this fixing unit fuses the toner image having transferred on the paper and fixes it onto the paper surface. The paper with a toner image fixed thereon is discharged outside from the image forming apparatus by the functions of discharge rollers, etc.

In the above way, during the image forming process in image forming portion 10, the toner alone is consumed from the developer stored in developing unit 4. Therefore, the toner concentration in the developer stored in developing unit 4 lowers as image forming is repeatedly performed and hence it becomes impossible to supply an adequate amount of toner from developing unit 4 to the static latent image formed on the photoreceptor drum 1 surface, producing insufficiency of the image density. To deal with this, a sensor for detecting the toner concentration in the developer stored in developing unit 4 is provided so as to rotate replenishing rollers 45 and 46 based on the detection result from this sensor to thereby supply the fresh toner and recycled toner from replenishing vessel 4*b* and collecting vessel 4*c*, respectively into developing hopper 4*a*.

Figure 3:
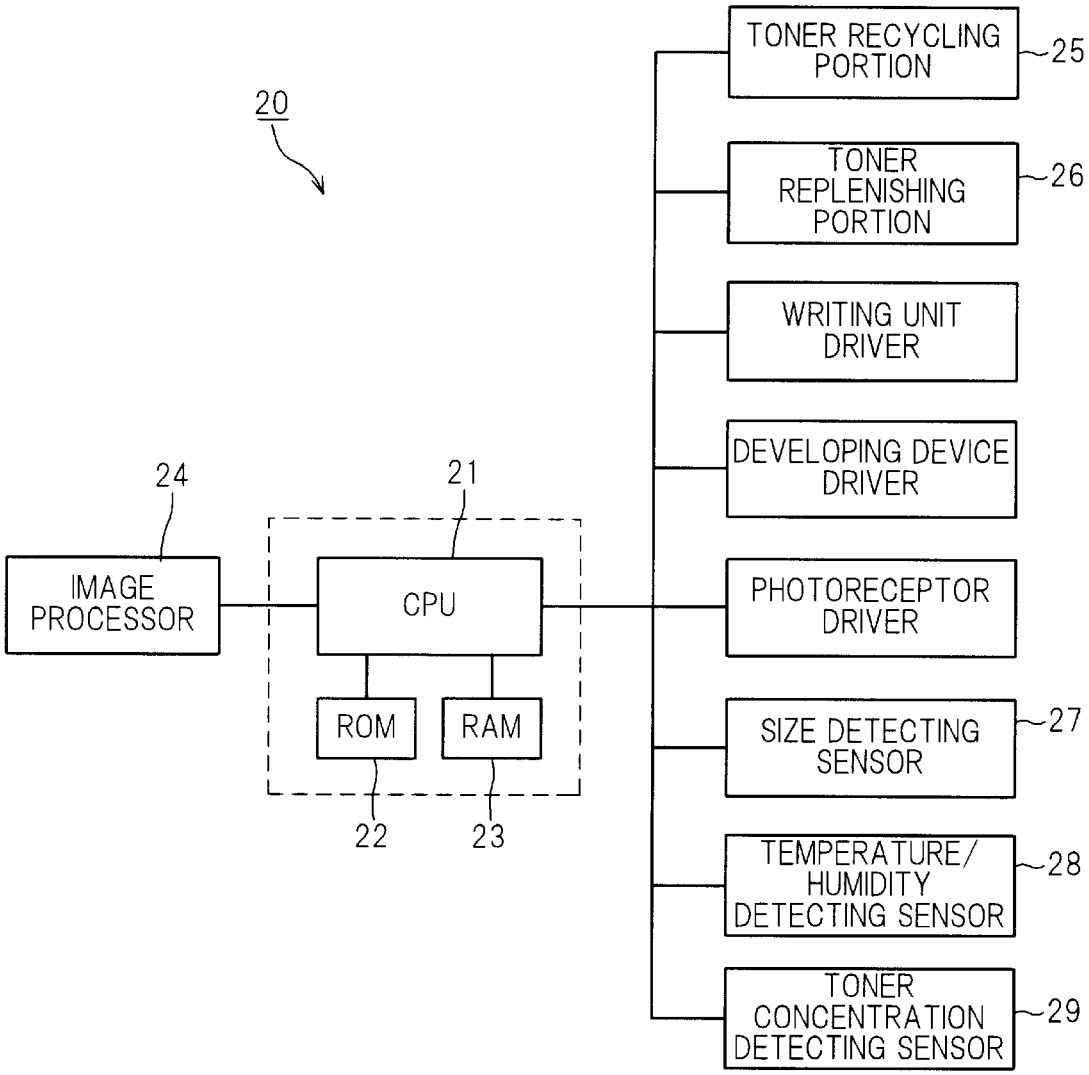
FIG. 3 is a block diagram showing the configuration of a controller of the image forming apparatus.

FIG. 3 is a block diagram showing a configuration of the controller of the above image forming apparatus. The controller, designated at 20, of the image forming apparatus includes a CPU 21 having a ROM 22 and a RAM 23, which is connected to input/output devices such as an image processor 24, a toner recycling portion 25, a toner replenishing portion 26, a size detecting sensor 27, a temperature/humidity detecting sensor 28, a toner concentration sensor 29 and the like. CPU 21 entirely controls these input/output devices as well as writing unit 3 etc. constituting image forming portion 10, in accordance with the program previously written in ROM 22.

Image processor 24 executes predetermined image processing of the image data input from an external apparatus through an unillustrated interface or the image signal captured from an original by means of an unillustrated scanner. Toner recycling portion 25, in response to a control signal issued from CPU 21, drives recycling device 8 so as to convey the residue removed by cleaning device 6 from the photoreceptor drum 1 surface to collecting vessel 4*c* of developing unit 4. Toner replenishing portion 26, based on a control signal issued from CPU 21, drives replenishing rollers 45 and 46, to supply the fresh toner and recycled toner from replenishing vessel 4*b* and collecting vessel 4*c* to developing hopper 4*a*.

Size detecting sensor 27 detects the size of the paper to be used for image forming. Temperature/humidity detecting sensor 28 detects the temperature and humidity near image forming portion 10 during image forming. Toner concentration sensor 29 is a sensor for detecting the toner concentration in the developer stored in developing hopper 4*a* and is of a magnetic permeability sensor, for example.

Figure 4:
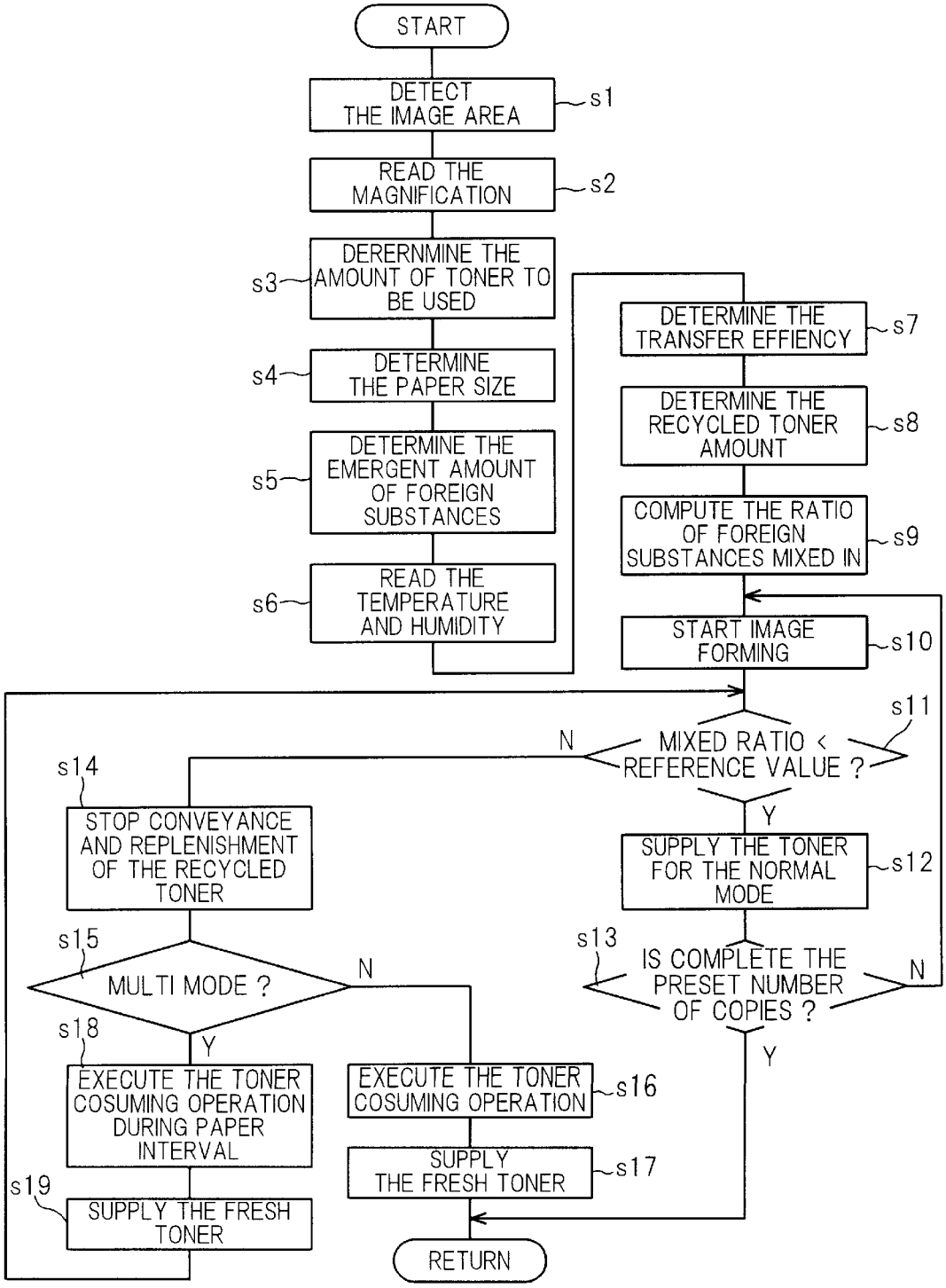
FIG. 4 is a flowchart showing the procedural steps effected by the controller of the image forming apparatus.

FIG. 4 is a flowchart showing the procedural steps in the controller of the image forming apparatus. CPU 21 constituting controller 20 of the image forming apparatus predicts the ratio of the foreign substances mixed in with the recycled toner, from the amounts of the recycled toner and foreign substances, such as paper dust, arising during an image forming operation, and controls, based on the predicted result, supplying of the fresh toner and the recycled toner from replenishing vessel 4*b* and collecting vessel 4*c* of developing unit 4 to developing hopper 4*a*.

Illustratively, at the start of an image forming operation, CPU 21, based on the image data obtained by pre-scan of the image of an original placed on the image reading portion, calculates the image area of the original (s1), reads the designated copy magnification (s2) and determines the amount of the toner to be used per sheet from the image area of the original and the copy magnification with reference to the previously set relationship (s3).

Here, the amount of toner to be used per sheet is determined from the image area of the original and copy magnification because of the following reason. That is, the amount of the toner to be used varies dependent upon the area of the image formed on the paper if the same size of the paper is used for image forming and the amount of the toner not having transferred from the photoreceptor drum 1 surface to the paper during the transfer step and remaining on the photoreceptor drum 1 surface varies, so the amount of the recycled toner arising during image forming varies.

Next, CPU 21 reads the paper size determined from the original size and the copy magnification (s4), and determines the amount of paper dust as a foreign substance arising and being mixed into the recycled toner, based on the paper size with reference to the previously set relationship (s5). Further, CPU 21 reads the detection result from temperature/humidity detecting sensor 28 (s6), determines transfer efficiency $\eta$ based on the detection result of the temperature and humidity (s7), and determines the amount of the recycled toner from the amount of the used toner and the transfer efficiency $\eta$ with reference to the previously set relationship (s8).

Here, the amount of the recycled toner is determined based on the amount of the used toner and transfer efficiency $\eta$ because of the following reason. That is, the transfer efficiency of the toner transferring from the photoreceptor drum 1 surface to the paper during the transfer step varies dependent upon the temperature and humidity, so the amount of the toner not having transferred from the photoreceptor drum 1 surface to the paper during the transfer step and remaining on the photoreceptor drum 1 surface varies with the variation of the transfer efficiency and hence the amount of the recycled toner arising during image forming varies.

Thereafter, CPU21, based on the emergent amount of foreign substances determined at s5 and the amount of the recycled toner determined at s8, calculates the ratio of foreign substances mixed in the recycled toner (s9). In this way, by determining the amount of the toner used based on the image area and determining the amount of the recycled toner based on the determined amount of the used toner and the transfer efficiency, it is possible to exactly calculate the ratio of mixed foreign substances representing the characteristics of the recycled toner.

Then, CPU 21 starts the operation relating to the image forming process (s10) and compares the ratio of mixed foreign substances determined at s9 to the reference value (s11). If the ratio of mixed foreign substances is lower than the reference value, CPU 21 performs toner replenishment in the normal mode (s12). For the toner replenishment in the normal mode, CPU 21 drives recycling device 8 so as to convey the recycled toner from cleaning device 6 to collecting vessel 4*c* and rotates replenishing rollers 45 and 46 in the predetermined ratio, whereby the fresh toner and recycled toner are supplied in the predetermined ratio from replenishing vessel 4*b* and collecting vessel 4*c* to developing hopper 4*a*. CPU 21 repeats the above steps s10 to s12 the designated number of times (s13).

At s1, if the ratio of mixed foreign substances in the recycled toner that has been removed from photoreceptor drum 1 by cleaning device 6 is equal to or greater than the reference value, CPU 21 stops the actions of recycling device 8 and replenishing roller 46 (s14) so as to stop the conveyance of the recycled toner from cleaning device 6 to collecting vessel 4*c* and the supply of the recycled toner from collecting vessel 4*c* to developing hopper 4*a*. Thus, the recycled toner containing a greater amount foreign substances than the reference value is prohibited from being used for subsequent image forming, to prevent the degradation of the image quality.

Then, CPU 21 makes a judgement of whether the multi-mode in which a single piece of image data is used to produce a multiple number of copies is set (s15). If the single mode in which a single piece of image data is used to produce one copy only is selected, CPU 21 executes a toner consuming operation whereby a fixed amount of toner is conveyed from developing unit 4 to cleaning device 6 by way of the photoreceptor drum 1 surface (s16) when preliminary rotation of photoreceptor drum 1 is made before the start of the actual image forming process or when post rotation of photoreceptor drum 1 is made after the end of the actual image forming process. At the same time, the CPU drives replenishing roller 45 so as to supply the fresh toner from replenishing vessel 4*b* to developing hopper 4*a* (s17). If a multi mode is selected, CPU 21 effects the toner consuming operation during the interval between image forming operations for one sheet and the next (s18) while driving replenishing roller 45 so as to supply the fresh toner from replenishing vessel 4*b* to developing hopper 4*a* (s19).

By these steps s15 to s19, if the ratio of foreign substances mixed in the recycled toner that has been removed from the photoreceptor 1 surface by means of cleaning device 6 is greater than the reference value, a fixed amount of toner is supplied from developing unit 4 to cleaning device 6 during preliminary rotation or post rotation of photoreceptor drum 1 or during the interval from image forming operations for one sheet to the next while the fresh toner is supplied from replenishing vessel 4*b* to developing hopper 4*a*, to increase the amount of the recycled toner in cleaning device 6, thus lowering the ratio of foreign substances mixed therein.

The toner consuming operation at s16 and s18 includes the steps of: forming a solid static latent image of a predetermined area on the photoreceptor drum 1 surface; making the toner adhere to the solid static latent image; and rotating photoreceptor drum 1 whilst the transfer step is omitted; and removing as the residual toner the toner adhering on the solid static latent image from the photoreceptor drum 1 by cleaning device 6.

Thus, in the image forming apparatus of this embodiment, the ratio of foreign substances mixed in the recycled toner that is removed from the photoreceptor drum 1 surface by means of cleaning device 6 during image forming is calculated as one of the characteristics of the recycled toner based on the paper size to be used for image forming, the image area and the transfer efficiency. When the ratio of foreign substances mixed in the recycled toner is high and hence it is determined that the recycled toner is low in quality, the collection of the recycled toner is temporarily stopped while a fixed amount of the toner is conveyed from developing unit 4 to cleaning device 6, whereby it is possible to improve the characteristics of the recycled toner. Thus, the recycled toner being low in quality will not be used for subsequent image forming operations, making it possible to prevent the image quality from being degraded.

If size detecting sensor 27 is of a type that detects the paper size, there is no need to calculate the paper size from the image size of the original and the magnification ratio.

Further, it is also possible to configure a system such that one of the operations, that is, either interruption of the conveyance of the recycled toner or the toner consuming operation for conveying a fixed amount of the fresh toner to cleaning device 6, will be executed when the quality of the recycled toner is judged to be low.

The relationships which are referred to for the determining steps including the step (s3) of determining the amount of the toner used per sheet from the image area of the original and magnification ratio, the step (s5) of determining the amount of paper dust arising and being mixed as foreign substances into the recycled toner from the paper size, and the step (s8) of determining the amount of the recycled toner from the amount of the used toner and the transfer efficiency $\eta$, can be stored beforehand into ROM 22 as a table shown in FIG. 5.

In an example shown in FIG. 5, the relationships between the amount of the used toner, the amount of the recycled toner and the amount of foreign substances arising are shown with respect to the paper size by taking the case in which an A4 size original having a normal image area is image formed isometrically as the standard state and comparing the states of low image area and the high image area with the standard state. More specifically, in the contents shown in FIG. 5, the amount of the toner used when an A4 size original having a standard image area is image formed isometrically is assumed as W, and the amount of the used toner and the amount of the recycled toner when the original size, magnification and the image area are varied are represented as functions of W. Further, the amount of foreign substances arising when an A4 size original having a normal image area is image formed isometrically is assumed as X, the amount of foreign substances arising when the original size, magnification and image area are varied is represented as a function of X. These values can be determined experimentally. Here, if size detecting sensor 27 is of a type that detects the paper size, it is possible to omit the data as to the original size and magnification in the table shown in FIG. 5.

It is also possible to previously store the relationships which are referred to for determining the amount of the recycled toner and determining the transfer efficiency $\eta$ from the detected result of the temperature and humidity (s7) as a table in ROM 22.

Figure 6:
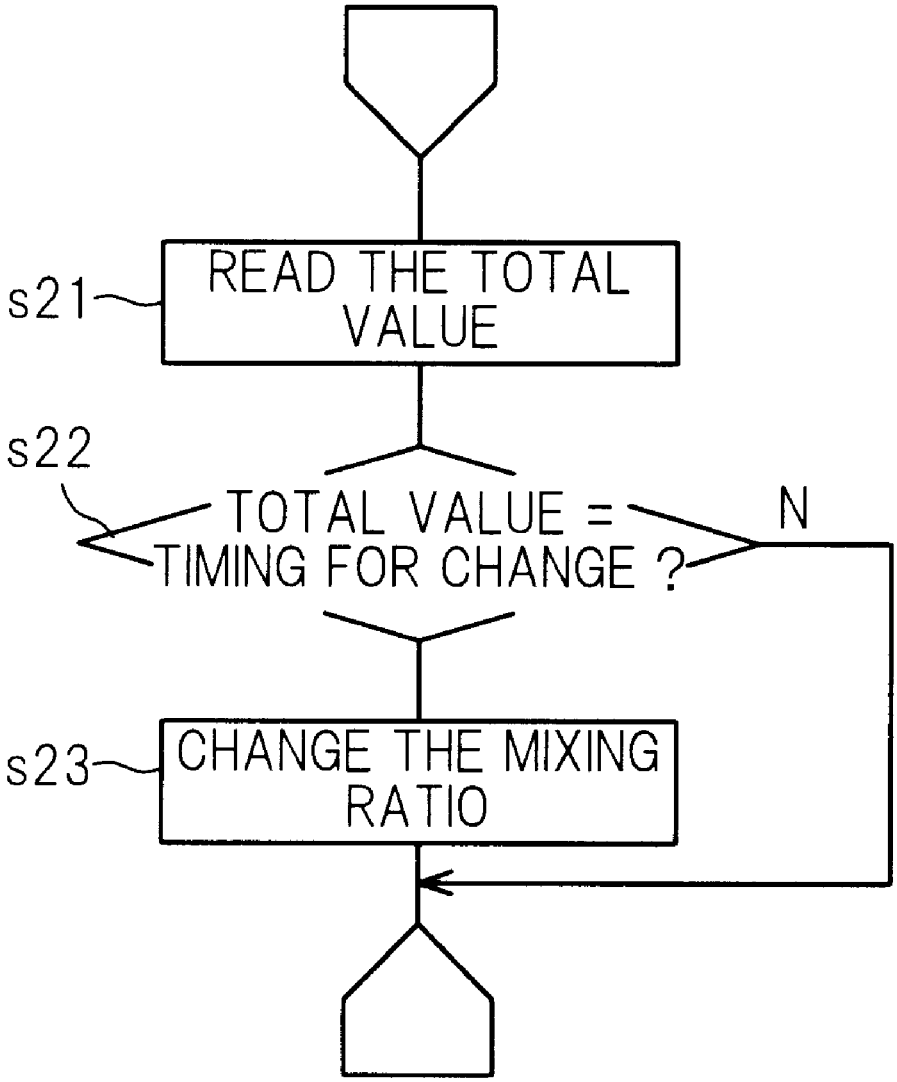

FIG. 6 is a flowchart showing a partial flow of procedural steps of the controller of the image forming apparatus in accordance with another embodiment of the present invention. A CPU 21 constituting the controller of the image forming apparatus according to this embodiment alters the replenishing ratio between the fresh toner and the recycled toner in accordance with the total number of image forming operations in the image forming apparatus, in place of the toner replenishing step in the normal mode at s12 shown in FIG. 4.

Therefore, CPU 21 reads the total number of image forming operations on the counter which, for example, is assigned on a predetermined memory area in RAM 23 (s21) when the ratio of foreign substances mixed in the recycled toner is lower than the reference value, and judges whether the obtained total number corresponds to the predetermined value as the timing of alternation of the mixing ratio between the fresh toner and the recycled toner (s22). If the total number of image forming operations corresponds to the timing of alternation, CPU 21 alters the mixing ratio between the fresh toner and the recycled toner and sets up another mixing ratio (s23).

By the steps s21 to s23, the ratio between the amounts of the fresh toner and recycled toner supplied from replenishing vessel 4*b* and collecting vessel 4*c* to developing hopper 4*a* during image forming is changed as the number of image forming operations increases so that the ratio of the recycled toner to the fresh toner is reduced stepwise. In an image forming apparatus having a toner recycling function, the ratio of the toner having been recycled multiple number of times increases so the quality of the recycled toner itself lowers. This can be compensated by stepwise increasing of the amount of the fresh toner in the toner to be supplied to developing hopper 4*a* as the total number of image forming operations increases. That is, it is possible to suppress the degradation of the image forming state due to lowering the quality of the recycled toner itself.

The total value of the number of image forming operations may be cleared when, for example, the developer inclusive of the carrier in developing unit 4 is replaced, when the entire unit of image forming portion 10 including developing unit 4 is replaced, or at other events.

The initial setting of the mixing ratio between the fresh toner and recycled toner in the toner replenishment in the normal mode can be set at about 7:3 by weight, for instance.

In place of the total value of the number of image forming operations, the total value of the total number of revolutions of photoreceptor drum 1 for image forming or the total value of the total rotating time of photoreceptor drum 1 may also be used for the above operation. In this way, the mixing ratio between the fresh toner and recycled toner in the replenishing toner is altered based on the total value of the total number of revolutions, or the total rotational time, of photoreceptor drum 1, so the characteristics of the recycled toner can be determined not only based on the mixed amount of foreign substances but also based on the mechanical stress imposed on the recycled toner when it is removed from photoreceptor drum 1 as well as aging of the recycled toner with time, thus making it possible to correctly determine the characteristics of the recycled toner based on total information.

In accordance with the invention described in the first feature, the storage state of the toner in the developing portion is controlled in accordance with the characteristics of the recycled toner that have been predicted based on the image forming conditions and environmental conditions for individual image forming operations. Therefore, when the recycled toner having varying characteristics depending upon the image forming conditions and environmental conditions for individual image forming operations is collected into the developing portion and reused together with the fresh toner for subsequent image forming operations, the storage state of the recycled toner and fresh toner in the developing portion can be controlled based on the characteristics of the recycled toner, thus making it possible to regulate the influence of the characteristics of the recycled toner upon the image forming state and hence constantly keep the image forming state in a good condition.

In accordance with the invention described in the second feature, the storage state of the toner in the developing portion is controlled based on the state of foreign substances mixed in the recycled toner. Therefore, the storage state of the recycled toner and fresh toner in the developing portion can be controlled based on the state of foreign substances mixed in the recycled toner, thus making it possible to regulate the influence of the state of foreign substances mixed in the recycled toner upon the image forming state and hence constantly keep the image forming state in a good condition.

In accordance with the invention described in the third feature, the state of foreign substances mixed in the recycled toner is predicted based on the measurements of the numbers of image forming operations for individual sizes of recording media as the image forming factors having influence on the emergent amount of paper dust and based on the measurements of the temperature and humidity during image forming as the factors having influence on the transfer efficiency which determines the amount of recycled toner. The storage state of the recycled toner and fresh toner in the developing portion is controlled based on the predicted result. Therefore, it is possible to control the storage state of the recycled toner and fresh toner in the developing portion based on the predicted amount of paper dust mixed in the recycled toner, which is predicted from the emergent amount of paper dust based on the numbers of image forming operations for individual sizes of recording media and from the amount of recycled toner based on the temperature and humidity during image forming. As a result, it is possible to regulate the influence of the amount of paper dust mixed in the recycled toner upon the image forming state and hence constantly keep the image forming state in a good condition.

In accordance with the invention described in the fourth feature, the amount of the fresh toner replenishing the developing portion is controlled in accordance with the characteristics of the recycled toner that have been predicted based on the image forming conditions and environmental conditions for individual image forming operations. Therefore, when the recycled toner having varying characteristics depending upon the image forming conditions and environmental conditions for individual image forming operations is collected into the developing portion and reused together with the fresh toner for subsequent image forming operations, the ratio of the fresh toner occupying in the developer in the developing portion can be controlled based on the characteristics of the recycled toner, thus making it possible to regulate the influence of the characteristics of the recycled toner upon the image forming state and hence constantly keep the image forming state in a good condition.

In accordance with the invention described in the fifth feature, the amount of collection of the recycled toner into the developing portion is controlled in accordance with the characteristics of the recycled toner that have been predicted based on the image forming conditions and environmental conditions for individual image forming operations. Therefore, when the recycled toner having varying characteristics depending upon the image forming conditions and environmental conditions for individual image forming operations is collected into the developing portion and reused together with the fresh toner for subsequent image forming operations, the ratio of the recycled toner occupying in the developer in the developing portion can be controlled based on the characteristics of the recycled toner, thus making it possible to regulate the influence of the characteristics of the recycled toner upon the image forming state and hence constantly keep the image forming state in a good condition.

In accordance with the invention described in the sixth feature, the characteristics of the recycled toner are improved in accordance with the characteristics of the recycled toner that have been predicted based on the image forming conditions and environmental conditions for individual image forming operations. Therefore, the recycled toner improved in its characteristics can be used together with the fresh toner for subsequent image forming operations, thus making it possible to regulate the influence of the characteristics of the recycled toner upon the image forming state and hence constantly keep the image forming state in a good condition.

In accordance with the invention described in the seventh feature, the toner consuming operation for conveying the toner stored in the developing portion to the cleaning device via the photoreceptor surface is effected in accordance with the characteristics of the recycled toner that have been predicted based on the image forming conditions and environmental conditions for individual image forming operations. Therefore, the fresh toner stored in the developing portion is mixed with the recycled toner in the cleaning device by way of the photoreceptor surface, so as to lower the mixed ratio of foreign substances in the recycled toner, thus making it possible to regulate the influence of the characteristics of the recycled toner upon the image forming state and hence constantly keep the image forming state in a good condition.

In accordance with the invention described in the eighth feature, the toner consuming operation for conveying the toner stored in the developing portion to the cleaning device via the photoreceptor surface is effected during a non-image forming operation in accordance with the characteristics of the recycled toner that have been predicted based on the image forming conditions and environmental conditions for individual image forming operations. Therefore, it is possible to improve the characteristics of the recycled toner without having any influence on image forming.

What is claimed is:

1. An image forming apparatus for forming images by electrophotography using a dual-component developer consisting of a toner and a carrier wherein the toner remaining on the photoreceptor surface after completion of the transfer step is removed by the cleaning device, collected and returned to the developing portion as the recycled toner and reused together with the fresh toner for a subsequent developing step, comprising a controller which predicts the characteristics of the recycled toner based on the image forming conditions and the environmental conditions for individual image forming operations and executes control of the storage state of the toner in the developing portion in accordance with the prediction.

2. The image forming apparatus according to claim 1, wherein the characteristics of the recycled toner predicted by the controller include the state of foreign substances mixed in the recycled toner.

3. The image forming apparatus according to claim 2, wherein the controller comprises:

a means for measuring the numbers of image forming operations for individual sizes of recording media used for image forming operations as the image forming conditions having influence on the emergent amount of paper dust; and a means for measuring the temperature and humidity during image forming as the environmental conditions having influence on the amount of recycled toner.

4. The image forming apparatus according to claim 1, 2 or 3, wherein the control made by the controller includes the step of controlling the amount of the fresh toner replenishing the developing portion.

5. The image forming apparatus according to claim 1, 2 or 3, wherein the control made by the controller comprises a step of constraining collection of the recycled toner to the developing portion.

6. The image forming apparatus according to claim 1, 2 or 3, wherein the control made by the controller comprises a control step for improving the characteristics of the recycled toner.

7. The image forming apparatus according to claim 6, wherein the control for improving the characteristics of the recycled toner is a toner consuming operation f or conveying the toner stored in the developing portion to the cleaning device by way of the photoreceptor surface.

8. The image forming apparatus according to claim 7, wherein the toner consuming operation is effected during a non-image forming operation.

* * * * *